US006838604B2

(12) United States Patent
Abe et al.

(10) Patent No.: US 6,838,604 B2
(45) Date of Patent: Jan. 4, 2005

(54) WOODEN BARS ARRANGED FOR PERCUSSION INSTRUMENTS

(75) Inventors: Hiroyasu Abe, Hamamatsu (JP); Masayuki Kato, Iwata-gun (JP); Yasumasa Shimizu, Hamamatsu (JP); Yasuyuki Semba, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 10/235,481

(22) Filed: Sep. 6, 2002

(65) Prior Publication Data

US 2003/0167899 A1 Sep. 11, 2003

(30) Foreign Application Priority Data

Sep. 7, 2001 (JP) ..... 2001-272647

(51) Int. Cl.[7] ..... G10D 13/08

(52) U.S. Cl. ..... 84/402; 84/403; 84/404; 84/433

(58) Field of Search ..... 84/402, 403, 404, 84/433

(56) References Cited

U.S. PATENT DOCUMENTS 4,411,187 A * 10/1983 Roper et al. ..... 84/402
4,649,791 A * 3/1987 Sawada et al. ..... 84/402
5,333,527 A * 8/1994 Janes et al. ..... 84/291
5,469,769 A * 11/1995 Sawada et al. ..... 84/193
6,365,812 B1 * 4/2002 McGill ..... 84/414

FOREIGN PATENT DOCUMENTS

| | | |
|---|---|---|
| JP | 51 127712 | 11/1976 |
| JP | 59 10994 | 1/1984 |
| JP | 60 159894 | 8/1985 |

* cited by examiner

*Primary Examiner*—Shih-Yung Hsieh
(74) *Attorney, Agent, or Firm*—Dickstein, Shapiro, Morin & Oshinsky, L.L.P.

(57) ABSTRACT

A prescribed number of bars are arranged in a percussion instrument such as a xylophone and marimba, wherein each bar is formed by a base layer, a fiber reinforced plastic layer, and a surface layer that are combined together using an epoxy adhesive therebetween. Both the base layer and surface layer is made of the prescribed hardwood material such as rosewood, hard birch, padauk, and Chinese quince, while the fiber reinforced plastic layer is formed by laminating one or more fiber reinforced plastic sheets, each of which is formed by impregnating and hardening thermosetting epoxy resin with fibers. All fibers can be aligned in a single direction slanted to the longitudinal direction of the bar. Alternatively, fibers are woven in two directions rectangularly crossing each other in a cloth form. Thus, it is possible to improve bars in striking durability as well as in sound quality and design.

15 Claims, 7 Drawing Sheets

| TEST NUMBER | FIBER DIRECTION | NUMBER OF LAMINATED SHEETS | LAMINATED CONFIGURATION OF BAR |
|---|---|---|---|
| 1 | SINGLE DIRECTION45° | 0.25mm×1 | WOOD (VENEER)+CFRP+WOOD |
| 2 | SINGLE DIRECTION45° | 0.25mm×1 | WOOD (VENEER)+CFRP+WOOD |
| 3 | SINGLE DIRECTION45° | 0.25mm×3 | WOOD (VENEER)+CFRP+WOOD |
| 4 | SINGLE DIRECTION45° | 0.25mm×3 | WOOD (VENEER)+CFRP+WOOD |
| 5 | SINGLE DIRECTION45° | 0.25mm×4 | WOOD (VENEER)+CFRP+WOOD |
| 6 | SINGLE DIRECTION45° | 0.25mm×4 | WOOD (VENEER)+CFRP+WOOD |
| 7 | SINGLE DIRECTION90° | 0.25mm×1 | WOOD (VENEER)+CFRP+WOOD |
| 8 | SINGLE DIRECTION90° | 0.25mm×1 | WOOD (VENEER)+CFRP+WOOD |
| 9 | SINGLE DIRECTION90° | 0.25mm×2 | WOOD (VENEER)+CFRP+WOOD |
| 10 | SINGLE DIRECTION90° | 0.25mm×2 | WOOD (VENEER)+CFRP+WOOD |
| 11 | SINGLE DIRECTION90° | 0.25mm×4 | WOOD (VENEER)+CFRP+WOOD |
| 12 | SINGLE DIRECTION90° | 0.25mm×4 | WOOD (VENEER)+CFRP+WOOD |
| 13 | CROSS45° | 0.25mm×1 | WOOD (VENEER)+CFRP+WOOD |
| 14 | CROSS45° | 0.25mm×1 | WOOD (VENEER)+CFRP+WOOD |
| 15 | CROSS45° | 0.25mm×2 | WOOD (VENEER)+CFRP+WOOD |
| 16 | CROSS45° | 0.25mm×2 | WOOD (VENEER)+CFRP+WOOD |
| 17 | CROSS45° | 0.25mm×4 | WOOD (VENEER)+CFRP+WOOD |
| 18 | CROSS45° | 0.25mm×4 | WOOD (VENEER)+CFRP+WOOD |
| 19 | CROSS90° | 0.25mm×1 | WOOD (VENEER)+CFRP+WOOD |
| 20 | CROSS90° | 0.25mm×1 | WOOD (VENEER)+CFRP+WOOD |
| 21 | CROSS90° | 0.25mm×2 | WOOD (VENEER)+CFRP+WOOD |
| 22 | CROSS90° | 0.25mm×2 | WOOD (VENEER)+CFRP+WOOD |
| 23 | CROSS90° | 0.25mm×4 | WOOD (VENEER)+CFRP+WOOD |
| 24 | CROSS90° | 0.25mm×4 | WOOD (VENEER)+CFRP+WOOD |
| 25 | SINGLE DIRECTION45° | 0.25mm×2×2 | CFRP+WOOD+CFRP |
| 26 | SINGLE DIRECTION90° | 0.25mm×2×2 | CFRP+WOOD+CFRP |
| 27 | CROSS45° | 0.25mm×2×2 | CFRP+WOOD+CFRP |
| 28 | CROSS90° | 0.25mm×2×2 | CFRP+WOOD+CFRP |

FIG. 6

| TEST NUMBER | DENSITY ($g/cm^3$) | $E_L$ ($10^{-9}$dyn/$cm^2$) | $E_L/G_{LT}$ | tan $\delta$ ($\times 10^{-3}$) |
|---|---|---|---|---|
| 1 | 1.1541 | 236.29 | 8.20 | 3.83 |
| 2 | 1.1127 | 225.87 | 7.89 | 3.68 |
| 3 | 1.1105 | 236.45 | 8.30 | 3.46 |
| 4 | 1.1318 | 253.94 | 8.97 | 3.36 |
| 5 | 1.1474 | | | 3.89 |
| 6 | 1.1463 | | | 3.73 |
| 7 | 1.1332 | 246.83 | 7.76 | 3.64 |
| 8 | 1.1112 | 226.02 | 5.89 | 3.39 |
| 9 | 1.1024 | 230.80 | 7.68 | 3.45 |
| 10 | 1.0879 | 224.60 | 6.55 | 3.33 |
| 11 | 1.1332 | 211.68 | 7.17 | 3.78 |
| 12 | 1.1230 | 240.54 | 9.62 | 3.42 |
| 13 | 1.1445 | 242.26 | 13.14 | 3.51 |
| 14 | 1.1419 | 255.16 | 9.80 | 3.16 |
| 15 | 1.1055 | 231.18 | 7.41 | 3.79 |
| 16 | 1.1337 | 233.36 | 6.35 | 3.80 |
| 17 | 1.1019 | 225.34 | 7.18 | 3.60 |
| 18 | 1.1234 | 238.43 | 7.11 | 3.55 |
| 19 | 1.1484 | 231.90 | 17.63 | 4.09 |
| 20 | 1.1421 | 194.77 | 7.62 | 4.14 |
| 21 | 1.1481 | 225.67 | 6.83 | 3.67 |
| 22 | 1.1237 | 229.11 | 6.61 | 3.75 |
| 23 | 1.1347 | 248.94 | 7.52 | 3.31 |
| 24 | 1.1277 | 236.31 | 9.58 | 3.67 |
| 25 | 1.1292 | 223.28 | 9.86 | 3.52 |
| 26 | 1.1326 | 222.57 | 5.32 | 3.76 |
| 27 | 1.1391 | 226.54 | 9.71 | 3.66 |
| 28 | 1.1197 | 223.98 | 6.52 | 3.76 |

FIG. 7

| TEST NUMBER | DENSITY ($g/cm^3$) | $E_L$ ($10^{-9}$dyn/$cm^2$) | $E_L/G_{LT}$ | tan $\delta$ ($\times 10^{-3}$) |
|---|---|---|---|---|
| 1 | 1.1567 | 237.98 | 7.29 | 3.44 |
| 2 | 1.1162 | 226.86 | 8.26 | 3.58 |
| 3 | 1.1287 | 238.54 | 8.26 | 3.62 |
| 4 | 1.1546 | 234.56 | 8.51 | 3.60 |
| 5 | 1.1611 | 217.73 | 7.50 | 3.76 |
| 6 | 1.1659 | 223.61 | 4.09 | 3.78 |
| 7 | 1.1438 | 232.31 | 8.32 | 3.85 |
| 8 | 1.1227 | 221.11 | 5.97 | 3.53 |
| 9 | 1.1196 | 232.60 | 8.10 | 3.53 |
| 10 | 1.1019 | 223.06 | 7.13 | 3.48 |
| 11 | 1.1583 | 224.76 | 8.75 | 3.47 |
| 12 | 1.1423 | 233.56 | 8.48 | 3.53 |
| 13 | 1.1563 | 240.03 | 9.31 | 3.64 |
| 14 | 1.1469 | 239.85 | 8.91 | 3.40 |
| 15 | 1.1237 | 230.84 | 7.17 | 3.66 |
| 16 | 1.1452 | 228.85 | 6.54 | 3.85 |
| 17 | 1.1334 | 229.58 | 7.35 | 3.65 |
| 18 | 1.1258 | 229.26 | 8.30 | 3.62 |
| 19 | 1.1563 | 237.74 | 5.99 | 3.67 |
| 20 | 1.1449 | 213.40 | 7.32 | 3.78 |
| 21 | 1.1576 | 244.17 | 8.12 | 3.47 |
| 22 | 1.1369 | 240.85 | 7.71 | 3.43 |
| 23 | 1.1556 | 271.10 | 9.64 | 3.15 |
| 24 | 1.1494 | 249.29 | 9.64 | 3.61 |
| 25 | 1.1620 | 223.22 | 8.27 | 3.66 |
| 26 | 1.1722 | 201.00 | 5.46 | 4.10 |
| 27 | 1.1761 | 227.22 | 7.67 | 3.82 |
| 28 | 1.1561 | 308.65 | 9.28 | 2.67 |

FIG. 8

| TEST NUMBER | VARIATION RATE (%) OF $E_L$ | VARIATION RATE (%) OF $E_L/G_{LT}$ | VARIATION RATE (%) OF $\tan\delta$ |
|---|---|---|---|
| 1 | 0.72 | -11.10 | -10.18 |
| 2 | 0.44 | 4.69 | -2.72 |
| 3 | 0.88 | -0.48 | 4.62 |
| 4 | -7.63 | -5.13 | 7.14 |
| 5 | | | -3.34 |
| 6 | | | 1.34 |
| 7 | -5.88 | 7.22 | 5.77 |
| 8 | -2.17 | 1.36 | 4.13 |
| 9 | 0.78 | 5.47 | 2.32 |
| 10 | -0.69 | 8.85 | 4.50 |
| 11 | 6.18 | 22.04 | -8.20 |
| 12 | -2.90 | -11.85 | 3.22 |
| 13 | -0.92 | -29.15 | 3.70 |
| 14 | -6.00 | -9.08 | 7.59 |
| 15 | -0.15 | -3.24 | -3.43 |
| 16 | -1.93 | 2.99 | 1.32 |
| 17 | 1.88 | 2.37 | 1.39 |
| 18 | -3.85 | 16.74 | 1.97 |
| 19 | 2.52 | -66.02 | -10.27 |
| 20 | 9.57 | -3.94 | -8.70 |
| 21 | 8.20 | 18.89 | -5.45 |
| 22 | 5.12 | 16.64 | -8.53 |
| 23 | 8.90 | 28.19 | -4.83 |
| 24 | 5.49 | 0.63 | -1.63 |
| 25 | -0.03 | -16.13 | 3.98 |
| 26 | -9.69 | 2.63 | 9.04 |
| 27 | 0.30 | -21.01 | 4.37 |
| 28 | 37.80 | 42.33 | -28.99 |

FIG. 9

WOODEN BARS ARRANGED FOR PERCUSSION INSTRUMENTS

BACKGROUND OF THE INVENTION

1. Field of the Invention

This invention relates to wooden bars arranged on keyboards or frames of percussion instruments such as xylophones and marimbas.

2. Description of the Related Art

Generally, percussion instruments such as xylophones and marimbas have arranged multiple types of wooden or metal bars having different lengths on keyboards or frames, and players play these instruments by striking the bars with small hammers or mallets. Sounds produced by striking the bars resonate with designated pitches, which depend on the lengths of the bars.

As materials for use in the bars of the aforementioned percussion instruments, it is possible to use hardwood materials such as rosewoods, hard birches, padauks, and Chinese quinces as well as fiber reinforced plastics (FRP) such as carbon fiber reinforced plastics (CFRP) and glass fiber reinforced plastics.

Japanese Unexamined Patent Publication No. Sho 60-159894 discloses an example of a bar-type percussion instrument using wooden bars having specific frequencies arranged on a keyboard or frame, wherein as shown in FIGS. 5A and 5B, a hollow 11 is formed on the center of the backside of a wooden bar 10, so that the wooden bar 10 is tuned in such a way that the frequency ratio (i.e., a ratio between numbers of vibrations per unit time) in either the basic mode or high-order mode is increased to be substantially multiple times higher. This guarantees clear pitches (or intervals) in producing percussion sounds by striking bars with a mallet or the like.

Since the aforementioned bar is made of the prescribed wooden material, it may be superior in sound quality and (exterior) design. However, this bar has a relatively small thickness at the center portion corresponding to the formation of the hollow thereof and is fragile when struck with a mallet or the like. That is, there is a possibility that the bar may be easily broken or damaged due to fatigue caused by being repeatedly struck. In particular, a lower-pitch bar shown in FIG. 5B is greatly reduced in thickness at the center portion thereof compared with a higher-pitch bar shown in FIG. 5A. That is, the lower-pitch bar is easily broken or damaged by being repeatedly struck compared with the higher-pitch bar. When the bars arranged in the bar-type percussion instrument are partially broken or damaged, it may be necessary to replace the broken or damaged bars with new ones, or it may be necessary to tune the bar-type percussion instrument again. This causes problems in incurring additional cost and wasting time in the replacement of parts and tuning.

Japanese Unexamined Patent Publication No. Sho 51-127712 discloses another example of bars for use in percussion instruments, wherein bars are made of fiber reinforced plastics. That is, bars are produced by cutting fiber reinforced plastic materials into bars each having a prescribed shape. Since fiber reinforced plastic materials are hardly affected by weather conditions such as temperature and humidity, these bars are advantageous because they can be manufactured with uniform quality.

The bars made of fiber reinforced plastics may be highly improved in durability against striking; however, the player may experience a 'hard' striking feeling when striking these bars with a mallet. In addition, these bars have some drawbacks in sound quality because they produce only hard sounds and lack softness or mellowness, particularly in low pitch ranges. Since these bars are made of plastics, their exterior surfaces may lack luxuriousness in appearance and may be inferior in design. In addition, the bars made of fiber reinforced plastics may not be easily mechanically processed. Therefore, unlike the foregoing wooden bars as disclosed in Japanese Unexamined Patent Publication No. Sho 60-159894, these bars made of fiber reinforced plastics are hardly improved in sound quality by forming hollows on the undersides thereof.

Japanese Unexamined Patent Publication No. Sho 51-127712 also discloses another type of bar in which a wooden base layer is sandwiched between fiber reinforced plastic layers, which form exterior surfaces (sec FIG. 4). This bar may be improved in sound quality because the sound may efficiently propagate in the air and is retained for a relatively long time. However, when a hollow is formed in the underside of the bar, the aforementioned improvement in the sound quality may substantially vanish

SUMMARY OF THE INVENTION

It is an object of the invention to provide bars to be arranged in percussion instruments, which are increased in striking durability in low pitch ranges and produce sounds having superior sound quality, wherein the bars are also improved in design.

A prescribed number of bars are arranged in a percussion instrument such as a xylophone or marimba, wherein each bar of this invention is formed by a base layer, a fiber reinforced plastic layer, and a surface layer that are combined together using an epoxy adhesive therebetween. Both the base layer and surface layer is made of the prescribed hardwood material such as rosewood, hard birch, padauk, and Chinese quince, while the fiber reinforced plastic layer is formed by laminating one or more fiber reinforced plastic sheets, each of which is formed by impregnating and hardening thermosetting epoxy resin with fibers. All fibers can be aligned in a single direction that may be slanted by 45° or 90° against the longitudinal direction of the bar, for example. Alternatively, fibers are woven in two directions rectangularly crossing each other in a cloth form. Preferably, the base layer ranges from 10 mm to 30 mm in thickness, the fiber reinforced plastic layer ranges from 0.1 mm to 5 mm in thickness, and the surface layer (e.g., veneer) ranges from 0.1 mm to 5 mm in thickness. Thus, it is possible to noticeably improve bars in durability against striking with a mallet as well as in sound quality and design.

BRIEF DESCRIPTION OF THE DRAWINGS

These and other objects, aspects, and embodiments of the present invention will be described in more detail with reference to the following drawing figures, in which:

FIG. 6 is a table showing twenty-eight types of bars having various forms for testing;

FIG. 7 is a table showing relationships between various factors in measurement results of the twenty-eight types of bars with respect to first physical values;

FIG. 8 is a table showing relationships between various factors in measurement results of the twenty-eight types of bars with respect to second physical values; and FIG. 9 is a table showing relationships between variation rates of various factors in measurement results of the twenty-eight types of bars in testing.

DESCRIPTION OF THE PREFERRED EMBODIMENT

This invention will be described in further detail by way of examples with reference to the accompanying drawings.

Figure 1:
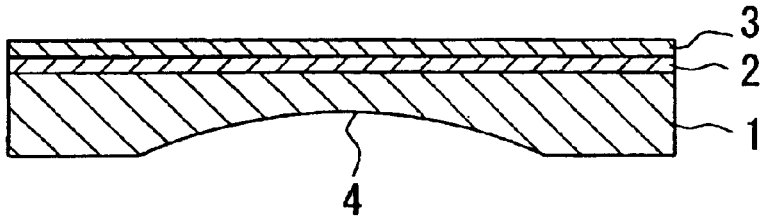
FIG. 1 is a sectional view showing the overall structure of a bar consisting of three layers and having a hollow in accordance with the preferred embodiment of the invention.

FIG. 1 is a sectional view showing the structure of a bar for use in a bar-type percussion instrument in accordance with the preferred embodiment of the invention. In FIG. 1, the bar is constituted by three layers 1, 2, and 3, wherein a wooden surface layer 3 is formed on a fiber reinforced plastic layer 2, which is formed on a base layer 1. These layers 1, 2, and 3 are adhered together using a prescribed adhesive such as an epoxy adhesive. That is, the epoxy adhesive is applied between the base layer 1 and the fiber reinforced plastic layer 2 and between the fiber reinforced plastic layer 2 and the wooden surface layer 3.

The base layer 1 is produced from the prescribed hardwood material such as rosewood, hard birch, padauk, and Chinese quince. That is, there is provided a relatively thick hardwood board whose thickness ranges from 10 mm to 30 mm, which is processed or cut into prescribed sizes and shapes.

The wooden surface layer 3 is produced from the prescribed hardwood material such as rosewood, hard birch, padauk, and Chinese quince. That is, there is provided a thin hardwood board whose thickness ranges from 0.1 mm to 5 mm, which is processed and cut into prescribed sizes and shapes.

As a material for use in production of the base layer 1 and the wooden surface layer 3, it is possible to select from among other wood materials generally known such as maple, hard maple, beech, mahogany, and birch.

As the fiber reinforced plastic layer 2, a single sheet or multiple sheets of fiber reinforced plastics are integrally laminated in a prescribed thickness ranging from 0.1 mm to 5 mm. Herein, the fiber reinforced plastic sheet is made using carbon fibers, which are impregnated into thermosetting epoxy resin and are hardened, for example.

The fiber reinforced plastic sheet is not limited in particular fiber directions. That is, it is possible to use the fiber reinforced plastic sheet whose fibers are aligned in a prescribed single direction. Alternatively, it is possible to use the fiber reinforced plastic sheet in which fibers are woven in two directions in the form of a cloth material. When the fiber reinforced plastic layer 2 is formed by laminating multiple fiber reinforced plastic sheets, it is possible to align fibers in a prescribed single direction in lamination, or it is possible to align fibers in two directions, which cross each other at a right angle or at a prescribed angle in lamination.

It is possible to adequately change dimensions of the base layer 1, fiber reinforced plastic layer 2, and surface layer 3 in conformity with the pitch (or interval) of the bar. In order to tune the pitch of the bar, one or multiple hollows 4 can be formed in the underside of the bar, which was conventionally demonstrated.

Specifically, the aforementioned bar can be produced by the following steps:

(1) The prescribed wood materials are processed or cut into prescribed sizes and shapes, thus forming the base layer 1 and the surface layer 3.
(2) An epoxy resin prepreg sheet is cut in conformity with dimensions of the bar, so that the prescribed number of sheets are laminated, heated, and hardened, thus forming the fiber reinforced plastic layer 2.
(3) The aforementioned layers 1, 2, and 3 are adhered together using cold setting epoxy adhesive. That is, the cold setting epoxy adhesive is applied between the base layer 1 and the fiber reinforced plastic layer 2 and between the fiber reinforced plastic layer 2 and the surface layer 3. After completion of the setting of the adhesive, finishing processes are performed on the aforementioned layers 1, 2, and 3 integrally combined together, thus completing the formation of the bar.

As described above, the bar of the present embodiment is constituted using the base layer 1 and the surface layer 3, both of which are made of wooden materials. Therefore, it is possible to produce a pleasant wood sound by striking the bar. In the tuning of the pitch of the bar, the hollow 4 can be formed on the underside of the base layer 1 by a relatively simple process. Due to the provision of the fiber reinforced plastic layer 2 arranged on the base layer 1, it is possible to improve the durability of the bar against striking. Therefore, it is possible to noticeably reduce likelihood that bars will be damaged or destroyed by being repeatedly struck. Since the surface layer 3 is made of the wooden material, the player may experience a relatively soft feeling when striking the bar. In addition, the appearance of the wooden surface layer 3 can be finished in a luxurious manner, so that the bar as a whole can be made with a good design.

The bar of the present embodiment may substantially match conventional bars in exterior appearance. Therefore, the bar-type percussion instrument can be constituted using mixtures of bars without causing differences in the overall appearance thereof. That is, bars of the present embodiment may be used in lower pitch ranges because lower-pitch bars whose thickness is greatly reduced due to the hollow, may be more easily damaged or broken, while conventional bars may be used in higher pitch ranges. Thus, the bar-type percussion instrument can be remarkably improved in both sound quality and durability.

Next, concrete examples of bars will be described in accordance with the present embodiment of the invention.

In order to test physical properties of bars, we, the inventors, actually produced twenty-eight types of bars, which are designated by test numbers '1' to '28' shown in FIG. 6. Herein, the twenty-eight types of bars are classified by three characteristics, namely, 'fiber direction', 'number of laminated sheets', and 'laminated configuration of bar'. Specifically, the fiber direction designates the direction(s) in which fibers are aligned in each fiber reinforced plastic sheet, and the number of laminated sheets designates the number of fiber reinforced plastic sheets that are laminated together. As fibers, it is possible to use natural fibers, glass fibers, carbon fibers, and aramid fibers, for example.

Figure 2A:
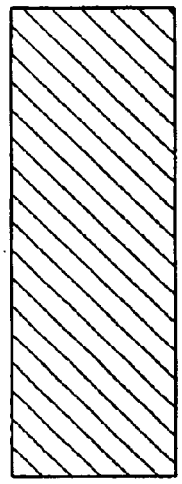
FIG. 2A diagrammatically shows an alignment of fibers in a single direction of 45° to the longitudinal direction of the bar.
Figure 2B:
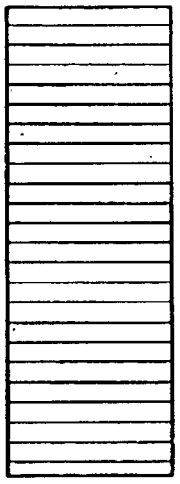
FIG. 2B diagrammatically shows an alignment of fibers in a single direction of 90° to the longitudinal direction of the bar.
Figure 2C:
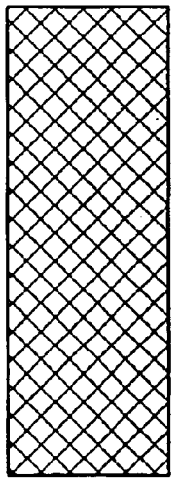
FIG. 2C diagrammatically shows an alignment of fibers in cross directions of 45° to the longitudinal direction of the bar.
Figure 2D:
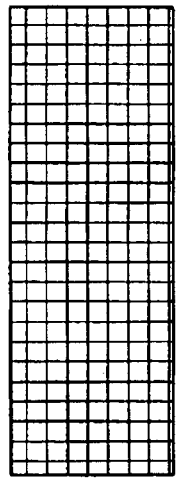
FIG. 2D diagrammatically shows an alignment of fibers in cross directions of 90° to the longitudinal direction of the bar.

In the table of FIG. 6, the fiber direction refers to two types of descriptions, namely, 'single direction' indicating a single direction in alignment of fibers in laminated sheets and 'cross' indicating cross directions in cloth-like alignment of fibers in laminated sheets. That is, single direction 45° indicates that all fibers are aligned in a single direction, which is at 45° to the longitudinal direction of the bar. Therefore, one or more fiber reinforced plastic sheets are laminated together in such a way that each sheet contains fibers, which are aligned in a single direction and are slanted by 45° to the longitudinal direction of the bar, an example of which is shown in FIG. 2A. In addition, single direction 90° indicates that all fibers are aligned in a single direction, which is at 90° to the longitudinal direction of the bar. Therefore, one or more fiber reinforced plastic sheets are laminated in a single direction and are slanted by 90° against the longitudinal direction of the bar, an example of which is shown in FIG. 2B. Further, cross 45° indicates that fibers are woven in two directions into a cloth, wherein alignment directions of fibers form +45° and −45° to the longitudinal direction of the bar. Therefore, one or more fiber reinforced plastic sheets are laminated in cross directions and are respectively slanted by +45° and −45° to the longitudinal direction of the bar, an example of which is shown in FIG. 2C. Furthermore, cross 90° indicates that fibers are woven in two directions into a cloth, wherein alignment directions of fibers form 0° and 90° to the longitudinal direction of the bar. Therefore, one or more fiber reinforced plastic sheets are laminated in cross directions and are respectively slanted by 0° and 90° to the longitudinal direction of the bar, an example of which is shown in FIG. 2D.

Next, a description will be given with respect to steps of producing the fiber reinforced plastic layer 2.

(1) The prescribed number of prepreg sheets, containing fibers impregnated in epoxy resin, are laminated together.
(2) The laminated prepreg sheets are cut into prescribed dimensions, that is, 600 mm in length and 80 mm in width, in conformity with dimensions of bars.
(3) Cutouts are each held in a aluminum metal mold and are then subjected to the prescribed pressure of 10 Kgf/cm$^2$ and are heated at the prescribed temperature of 130° C. for thirty minutes, so that they are subjected to press molding, thus forming the fiber reinforced plastic layer 2.

A more detailed description will be given with respect to steps of producing each of the bars whose test numbers range from '1' to '24' and each has the same laminated configuration consisting of 'wood (veneer)+CFRP+wood' (see FIG. 6).

(1) Hormigo is used as the designated wooden material of the bar, which is cut into the prescribed size and shape, i.e., a board of 600 mm in length, 80 mm in width, and 22 mm in thickness. This board is used for the base layer 1.
(2) The aforementioned fiber reinforced plastic layer 2, which is produced by the aforementioned method using a carbon fiber reinforced plastic material, is adhered onto the base layer 1.
(3) In addition, the surface layer 3, which is made of a veneer (or dressing board) whose thickness ranges from 3 mm to 4 mm, is adhered to the fiber reinforced plastic layer 2. Thus, it is possible to completely form the bar consisting of the aforementioned three layers 1, 2, and 3. Herein, adhesion is realized using cold setting epoxy adhesive. That is, after applying the adhesive between the layers 1 and 2 and between the layers 2 and 3, the bar is left to naturally dry for twelve hours or more while the adhesive is sufficiently hardened.

Figure 4:
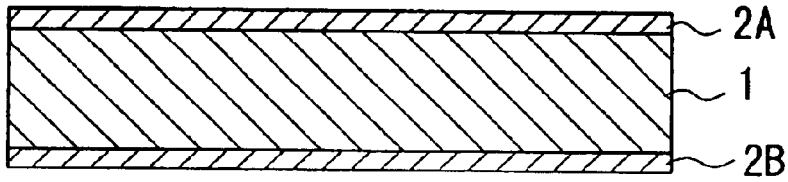
FIG. 4 is a sectional view diagrammatically showing the structure of a bar whose laminated configuration is expressed as 'CFRP+wood+CFRP'.
Figure 5A:
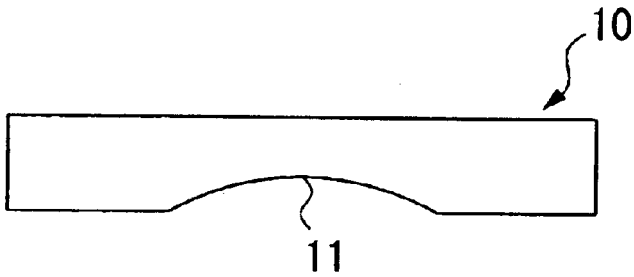
FIG. 5A shows a conventional example of a higher-pitch bar in side view.
Figure 5B:
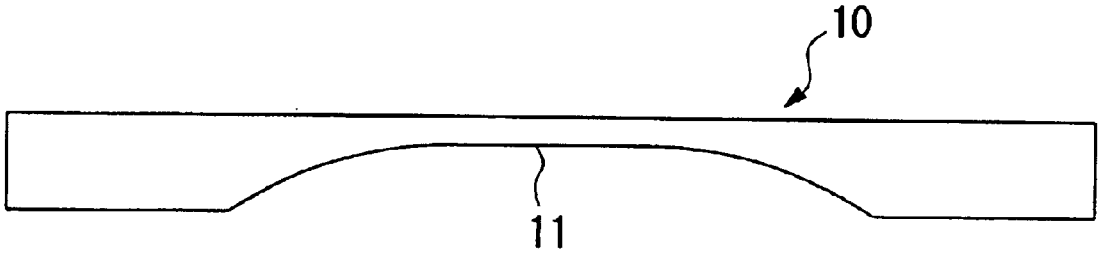
FIG. 5B shows a conventional example of a lower-pitch bar in side view.

Next, a detailed description will be given with respect to steps of producing each of bars whose test numbers range from '25' to '28' in FIG. 6 and each have the same laminated configuration consisting of 'CFRP+wood+CFRP'. An example of this bar is shown in FIG. 4 in which a base layer 1 is sandwiched between fiber reinforced plastic layers 2A and 2B.

(1) Hormigo is used as the designated wooden material of the bar, which is cut into the prescribed size and shape, i.e., a board of 600 mm in length, 80 mm in width, and 22 mm in thickness. This board is used for the base layer 1.
(2) Fiber reinforced plastic layers 2A and 2B are produced by the aforementioned method using carbon fiber reinforced plastic materials and are adhered to the surface and underside of the base layer 1 by use of cold setting epoxy adhesive.
(3) After applying the adhesive between the base layer 1 and fiber reinforced plastic layer 2A and between the base layer 1 and fiber reinforced plastic layer 2B, the bar shown in FIG. 4 is left to naturally dry for twelve hours or more while the adhesive is sufficiently hardened.

In order to evaluate sound qualities of the aforementioned bars (i.e., test numbers 1 to 28) which are produced using carbon fiber reinforced plastic materials, an FFT (i.e., fast Fourier transform) analyzer is used to perform measurement with respect to resonant frequencies and vibration attenuation factors in the basic mode, second-order mode, and third-order mode, respectively. Then, calculations are performed based on measurement results to produce values with respect to the Young's modulus $E_L$, ratio $E_L/G_{LT}$ between the Young's modulus $E_L$ and rigidity (or compressibility) $G_{LT}$, and internal loss tan δ. The values $E_L$ and $E_L/G_{LT}$ are calculated by the analysis based on Timoshenko's theory, while values tan δ are calculated from vibration attenuation factors in prescribed frequency bands in proximity to the resonance frequency in the basic mode.

Specifically, a first physical value is produced based on the measurement result of the base layer 1 before lamination; then, a second physical value is produced based on the measurement result of the bar after lamination. In order to evaluate effects of the fiber reinforced plastic layer 2 arranged for the bar, a variation rate of the second physical value with reference to the first physical value is calculated in the following equation.

$$(\text{variation rate in percentage } (\%))=\{(\text{second physical value})-(\text{first physical value})\}/(\text{first physical value})\times 100$$

Figure 3:
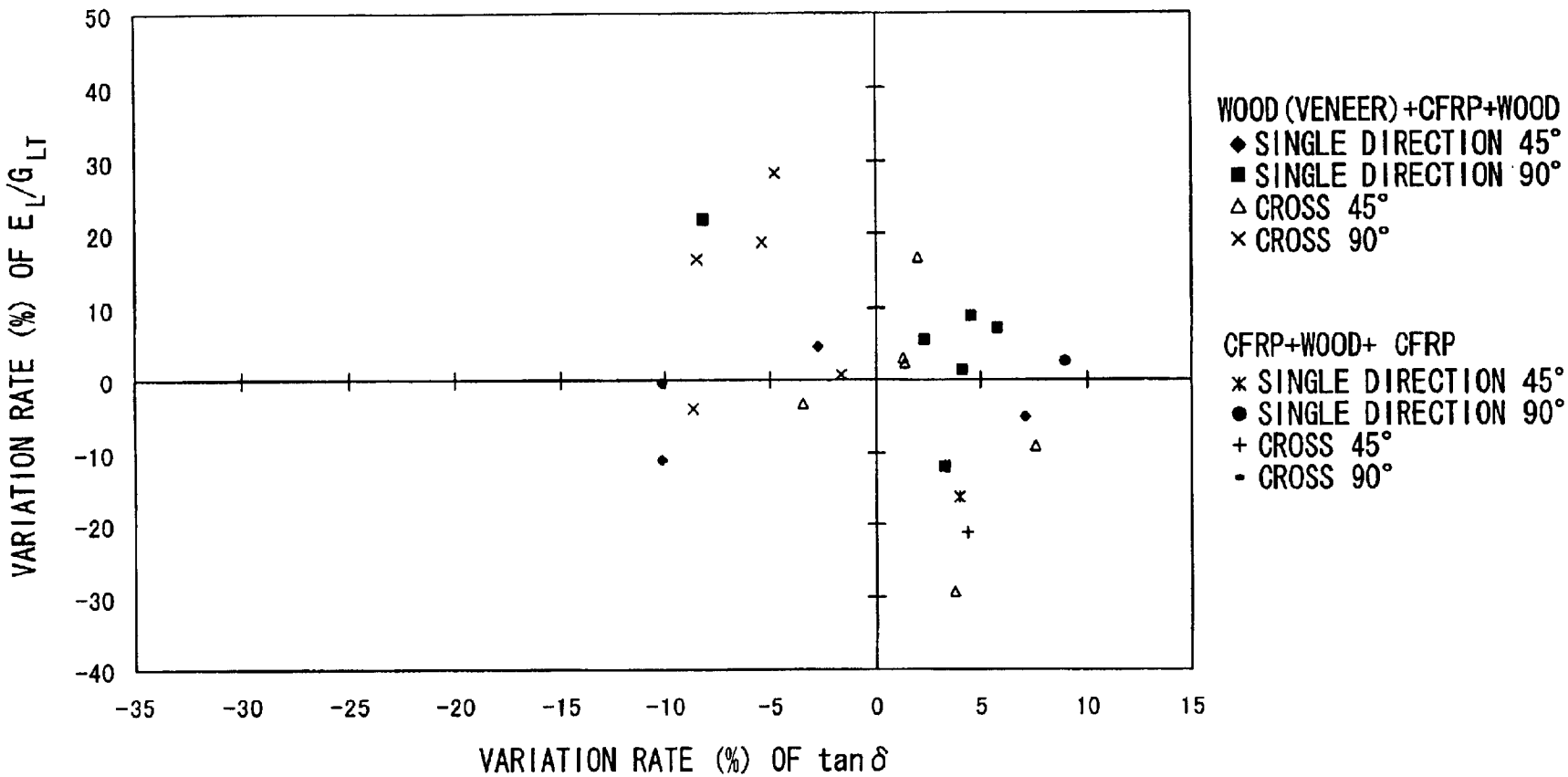
FIG. 3 is a graph showing relationships between variation rates of tan δ and $E_L/G_{LT}$ measured in concrete examples of bars produced in accordance with the invention.

FIG. 7 shows measurement results with respect to the first physical value, and FIG. 8 shows measurement results with respect to the second physical value. In addition, FIG. 3 shows relationships between variation rates with respect to $E_L/G_{LT}$ and tan δ.

FIG. 9 shows that the bars whose test numbers range from 1 to 24 demonstrate desired variation rates of the Young's modulus $E_L$ within ±10%. That is, these bars bear relatively small variations in sound quality. In contrast, variation rates of the ratio $E_L/G_{LT}$ may roughly tend to increase. In particular, the increasing tendency is clearly shown in each of the bars whose fiber reinforced plastic layer is formed by laminating two or more sheets and has a thickness of 0.5 mm or more, wherein these bars may provide a sound quality closer to that of simple wooden bars. All the bars whose test numbers range from 1 to 24 are decreased in the internal loss tan δ, so that the sounds of these bars are improved in propagation and continuity in the air.

In contrast to the aforementioned bars whose test numbers range from 1 to 24, the other bars whose test numbers range from 25 to 27 are extremely reduced in variation rates of the ratio $E_L/G_{LT}$, in particular in the negative direction. This may badly deteriorate the sound quality as wooden bars. In addition, the bar of the test number 26 provides a very large variation rate of tan δ; therefore, this bar is inferior in propagation and continuity of sound in the air. Furthermore, the bar of the test number 28 provides a very large variation rate of $E_L$; therefore, this bar is badly degraded in sound quality as a wooden bar.

As described heretofore, this invention has a variety of effects and technical features, which will be described below.

(1) Since each bar of this invention is formed using both the wooden material and fiber reinforced plastic material, the bars in lower pitch ranges have high durability against striking, wherein they are superior in sound quality as wooden bars and in exterior design. In addition, players experience good feeling when striking these bars.

(2) Since the bars of this invention have substantially no differences in appearance compared with the conventional wooden bars, it is possible to provide a unique combination of bars for use in a bar-type percussion instrument, wherein the bars of this invention are used for lower pitch ranges, while the conventional wooden bars are used for higher pitch ranges.

(3) Each bar of this invention is made of composite materials such as woods and plastics, it is possible to noticeably reduce the total amount of 'expensive' wood materials, which may contribute to the overall reduction in the cost in manufacture.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A bar for use in a percussion instrument comprising at least three layers including a wooden layer and a fiber reinforced plastic layer, wherein a prescribed wooden material is exposed on a surface thereof.

2. A bar for use in a percussion instrument, comprising:

a base layer made of a prescribed hardwood material;

a fiber reinforced plastic layer in which one or more fiber reinforced plastic sheets are laminated together; and a surface layer made of the prescribed hardwood material.

3. The bar for use in a percussion instrument according to claim 2, wherein the prescribed hardwood material is selected from among rosewood, hard birch, padauk, and Chinese quince.

4. The bar for use in a percussion instrument according to claim 2, wherein the fiber reinforced plastic sheets are each formed by impregnating and hardening a thermosetting epoxy resin with carbon fibers.

5. The bar for use in a percussion instrument according to claim 2, wherein fibers are all aligned in a single direction that is slanted to a longitudinal direction in the fiber reinforced plastic sheet.

6. The bar for use in a percussion instrument according to claim 5, wherein the single direction is slanted by 45° to the longitudinal direction in the fiber reinforced plastic sheet.

7. The bar for use in a percussion instrument according to claim 5, wherein the single direction is slanted by 90° to the longitudinal direction in the fiber reinforced plastic sheet.

8. The bar for use in a percussion instrument according to claim 2, wherein fibers are woven in two directions rectangularly crossing each other in the fiber reinforced plastic sheet.

9. The bar for use in a percussion instrument according to claim 8, wherein each of the two directions are slanted by 45° to the longitudinal direction in the fiber reinforced plastic sheet.

10. The bar for use in a percussion instrument according to claim 8, wherein one of the two directions are slanted by 90° to the longitudinal direction in the fiber reinforced plastic sheet.

11. The bar for use in a percussion instrument according to claim 2, wherein cold setting epoxy adhesive is applied between the base layer and the fiber reinforced plastic layer and between the fiber reinforced plastic layer and the surface layer in adhesion.

12. The bar for use in a percussion instrument according to claim 2, wherein the surface layer is constituted by a veneer.

13. The bar for use in a percussion instrument according to claim 2, wherein a hollow is formed on an underside of the base layer.

14. The bar for use in a percussion instrument according to claim 2, wherein the base layer ranges from 10 mm to 30 mm in thickness, the fiber reinforced plastic layer ranges from 0.1 mm to 5 mm in thickness, and the surface layer ranges from 0.1 mm to 5 mm in thickness.

15. A percussion instrument comprising:

a plurality of bars, each of which comprises a surface layer made of a wood material, at least one fiber reinforced plastic layer below the surface layer, and at least one wooden layer below the surface layer.

* * * * *